US012635811B2

(12) United States Patent
Longenecker et al.

(10) Patent No.: US 12,635,811 B2
(45) Date of Patent: May 26, 2026

(54) CHILD BOOSTER SEAT CONVERTIBLE TO FLOOR CHAIR

(71) Applicant: ARTSANA USA, INC., Lancaster, PA (US)

(72) Inventors: Michael L. Longenecker, Lancaster, PA (US); Derek A. Eberly, Red Lion, PA (US); Steve Wood, Kutztown, PA (US)

(73) Assignee: Artsana USA, Inc., Lancaster, PA (US)

( * ) Notice: Subject to any disclaimer, the term of this patent is extended or adjusted under 35 U.S.C. 154(b) by 138 days.

(21) Appl. No.: 18/607,684

(22) Filed: Mar. 18, 2024

(65) Prior Publication Data

US 2024/0324790 A1 Oct. 3, 2024

Related U.S. Application Data

(60) Provisional application No. 63/493,447, filed on Mar. 31, 2023.

(51) Int. Cl.

| | |
|---|---|
| ***A47D 1/02*** | (2006.01) |
| ***A47D 1/00*** | (2006.01) |
| ***A47D 1/10*** | (2006.01) |

(52) U.S. Cl.

CPC ..... *A47D 1/103* (2013.01); *A47D 1/0085* (2017.05); *A47D 1/02* (2013.01)

(58) Field of Classification Search

CPC ... A47D 1/00; A47D 1/02; A47D 1/10; A47D 15/00; A47D 1/008; A47D 1/004; A47D 1/023; A47C 1/02; A47C 1/10; A47C 1/14; A47C 1/16; A47C 4/00; E05D 3/00;

(Continued)

(56) References Cited

U.S. PATENT DOCUMENTS 1,739,366 A * 12/1929 Lang ..... A47D 1/103 4/239
2,603,274 A 7/1952 McClernon (Continued)

FOREIGN PATENT DOCUMENTS

CN 113811226 A * 12/2021 ..... A47B 3/0818
CN 119033236 A * 11/2024 ..... A47D 1/0085

(Continued)

OTHER PUBLICATIONS

O Title: Deluxe Comfort Folding Booster Seat Instruction Manual (Models 13050 / 13060 / 13520). o Date: 2015 (print code 8.16). o Publicly available at https://www.summerinfant.com/ and various retailers.

(Continued)

*Primary Examiner* — Justin M Benedik

(74) *Attorney, Agent, or Firm* — Saxton & Stump, LLC

(57) ABSTRACT

A convertible booster seat for use positioned on a convention chair or for use as a free-standing chair that features a pair of folding legs rotatably connected to a booster seat base and configurable in generally opposing folded and deployed positions. Moving the legs between the folded and deployed simultaneously shifts the legs longitudinally in relation to the seat base to improve stability when the booster seat is being used as a free-standing chair and to enable the legs to be stowed completely beneath the seat base when folded.

19 Claims, 13 Drawing Sheets

(58) Field of Classification Search
CPC .... E05D 3/06; E05D 3/12; E05D 7/00; E04H 15/00; F16M 11/42; F16M 11/46
See application file for complete search history.

(56) References Cited

U.S. PATENT DOCUMENTS

| | | | | | |
|---|---|---|---|---|---|
| 4,240,662 | A * | 12/1980 | Anderson | A47C 1/10 | 297/182 |
| 5,474,355 | A * | 12/1995 | Lerner | A47D 1/002 | 297/411.31 |
| 5,490,467 | A * | 2/1996 | Diffrient | A47B 3/0911 | 108/133 |
| 5,609,389 | A * | 3/1997 | Longoria | A47D 1/103 | 297/54 |
| 5,951,102 | A * | 9/1999 | Poulson | A47D 1/023 | 297/440.16 |
| 6,773,064 | B2 * | 8/2004 | Treen | A47D 1/103 | 297/255 |
| 7,201,445 | B1 * | 4/2007 | Dubiel | A47D 1/103 | 297/256.13 |
| 7,503,267 | B1 * | 3/2009 | Zemel | A47B 3/08 | 108/115 |
| 8,226,161 | B2 * | 7/2012 | Fiore, Jr. | A47D 1/103 | 297/148 |
| 9,339,118 | B2 | 5/2016 | Gubitosi et al. | | |
| 9,635,955 | B2 | 5/2017 | Greger | | |
| 9,974,396 | B2 | 5/2018 | Sozzo et al. | | |
| 10,172,476 | B2 | 1/2019 | Bellows et al. | | |
| 11,224,298 | B2 | 1/2022 | Tuckey | | |
| 11,523,691 | B1 | 12/2022 | Lai et al. | | |
| 2003/0067198 | A1 * | 4/2003 | Treen | A47D 1/103 | 297/250.1 |
| 2008/0303322 | A1 * | 12/2008 | Young | A47D 1/02 | 297/217.1 |
| 2020/0217115 | A1 * | 7/2020 | Nuss | E05D 3/06 | |
| 2024/0016311 | A1 * | 1/2024 | Li | A47D 13/02 | |
| 2024/0175306 | A1 * | 5/2024 | Margonari | E05F 1/1261 | |

FOREIGN PATENT DOCUMENTS

| | | | | |
|---|---|---|---|---|
| DE | 10104105 | A1 * | 8/2002 | A47B 3/0815 |
| GB | 2481628 | A * | 1/2012 | A47D 1/004 |
| GB | 2507834 | A * | 5/2014 | A47D 1/002 |
| KR | 101180862 | B1 * | 9/2012 | A47C 9/022 |
| WO | WO-03024282 | A1 * | 3/2003 | A47D 1/0085 |
| WO | 2021129946 | A1 | 7/2021 | |

OTHER PUBLICATIONS

1. Summer Infant "Deluxe Comfort Folding Booster Seat"—2007 Product Catalog o Source: Summer Infant Spring 2007 Catalog, pp. 37 ("Boosters" section). o Model No. 13050 (also 13054 multi-language packaging).

* cited by examiner

CHILD BOOSTER SEAT CONVERTIBLE TO FLOOR CHAIR

CROSS REFERENCE TO RELATED APPLICATIONS

This application claims priority benefit to provisional patent application 63/493,447 filed on Mar. 31, 2023, the entirety of which is incorporated by reference herein.

FIELD OF THE INVENTION

The present disclosure is generally directed to portable seating for small children, and more particularly to a portable seat that may be quickly and conveniently converted for use as a booster seat for use with a chair or as a free-standing chair.

BACKGROUND OF THE INVENTION

Portability and convenience of use of childcare accessories are increasingly important considerations among consumers. This is particularly important for child booster seats. Booster seats are designed to be placed in the seat of a chair to elevate a child occupant for improved access to an adjacent table.

Consumers may desire additional convenience in the booster seat. Means and mechanisms to conveniently secure the booster seat to a chair to prevent the seat from moving to the point at which the booster seat falls from the chair. Trays may also be attached to the booster seat to provide a dedicated eating surface for the child occupant for standalone use or to provide a catch surface between a normal table and the child to minimize food falling from the table.

Consumers may also desire alternate booster seat configurations allowing adjustment of the booster seat elevation above the chair seat. Such elevation may be desirable to provide room for the child occupant's legs to drop below the level of the booster seat or to allow an attached eating tray to extend above an adjacent table surface so the occupant can be more closely positioned adjacent to the table. Designers must ensure that the booster seat configurations provide are suitably stable in these alternate configurations.

Portability and ease of use remain of primary concern to consumers. As additional features and capabilities are added to the seat, the designs must enable the seat to be easily reconfigured into a compact form to allow easy transport and use by parents and other users.

What is needed is a booster seat featuring an attached tray and adjustment means to vary the height of the booster seat above the surface upon which it rests that may be easily folded into a compact, portable configuration for ease of transport. The height adjustment means should also provide stability in all modes of use. Other features and advantages will be made apparent from the present specification. The teachings disclosed extend to those embodiments that fall within the scope of the claims, regardless of whether they accomplish one or more of the aforementioned needs.

SUMMARY OF THE INVENTION

It is an object of the present invention to provide a convertible booster seat for use positioned on a convention chair or for use as a free-standing chair. The booster seat includes a pair of folding legs rotatably connected to a booster seat base and positionable in generally opposing folded and deployed positions. When folded, the legs are disposed substantially beneath the seat base. When deployed the legs extend downwardly from the seat base. Deploying the legs also shifts the legs longitudinally in relation to the seat base to improve stability when the booster seat is being used as a free-standing chair.

It is another object of the present invention to provide a mechanism for repositioning foldable legs on a convertible booster seat that includes a cam and guide arrangement that longitudinally shifts the legs fore and aft in concert with movement of the legs between folded and displaced positions. The legs may be pivotally connected to the seat base and the cam and guide arrangement may be integrated into the pivoting connection.

It is another object of the present invention to provide a convertible booster seat that is configured for compact folding. Folding legs are longitudinally shifted as the legs are moved toward the folded position enabling the legs to nest within the structure of the seat base. Unfolding the legs toward the deployed position shifts the legs rearwardly to improve stability when the booster seat is used as a free-standing chair.

It is still another object of the present invention to provide a portable, convertible booster seat that includes a moveable seatback connected to the seat base. Armrests having a support linkage interconnect the seatback and seat base and coordinate folding of the seatback. A tray may be connected to the armrests for movement therewith, coordinated folding of the seatback and armrests moving the tray to optimize compactness of the folded booster seat. In one embodiment, the tray is shifted forwardly and downwardly as the seatback is folded. In another embodiment the tray includes a downwardly extending "anti-submarine" horn which is forwardly displaced a distance sufficient to position the horn forward of the forwardmost edge of the seat base.

It is still another object of the present invention to provide a portable booster seat that includes a latch configured to retain the seat base and seatback in an operable configuration and to permit selective unlatching to permit the seat to be folded. The latch may be further configured to include a carry handle for subsequent carrying of the seat once folded.

It is yet another object of the present invention to provide a portable, convertible booster seat for use positioned on a convention chair or for use as a free-standing chair that is durable in construction, inexpensive of manufacture, carefree of maintenance, easily assembled, and simple and effective to use.

These and other objectives are addressed by a convertible booster seat for use positioned on a convention chair or for use as a free-standing chair that features a pair of folding legs rotatably connected to a booster seat base and configurable in generally opposing folded and deployed positions. Moving the legs between the folded and deployed simultaneously shifts the legs longitudinally in relation to the seat base to improve stability when the booster seat is being used as a free-standing chair and to enable the legs to be completely stowed beneath the seat base when folded.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

The advantages of this invention will be apparent upon consideration of the following detailed disclosure of the invention, especially when taken in conjunction with the accompanying drawings wherein.

Wherever possible, the same reference numbers will be used throughout the drawings to represent the same parts. Where reference numbers include orientation specific designations (e.g., "R" or "L"), use of the reference number without the orientation designation signifies a structure in general without signifying a specific orientation.

DETAILED DESCRIPTION OF THE INVENTION

Figure 1:
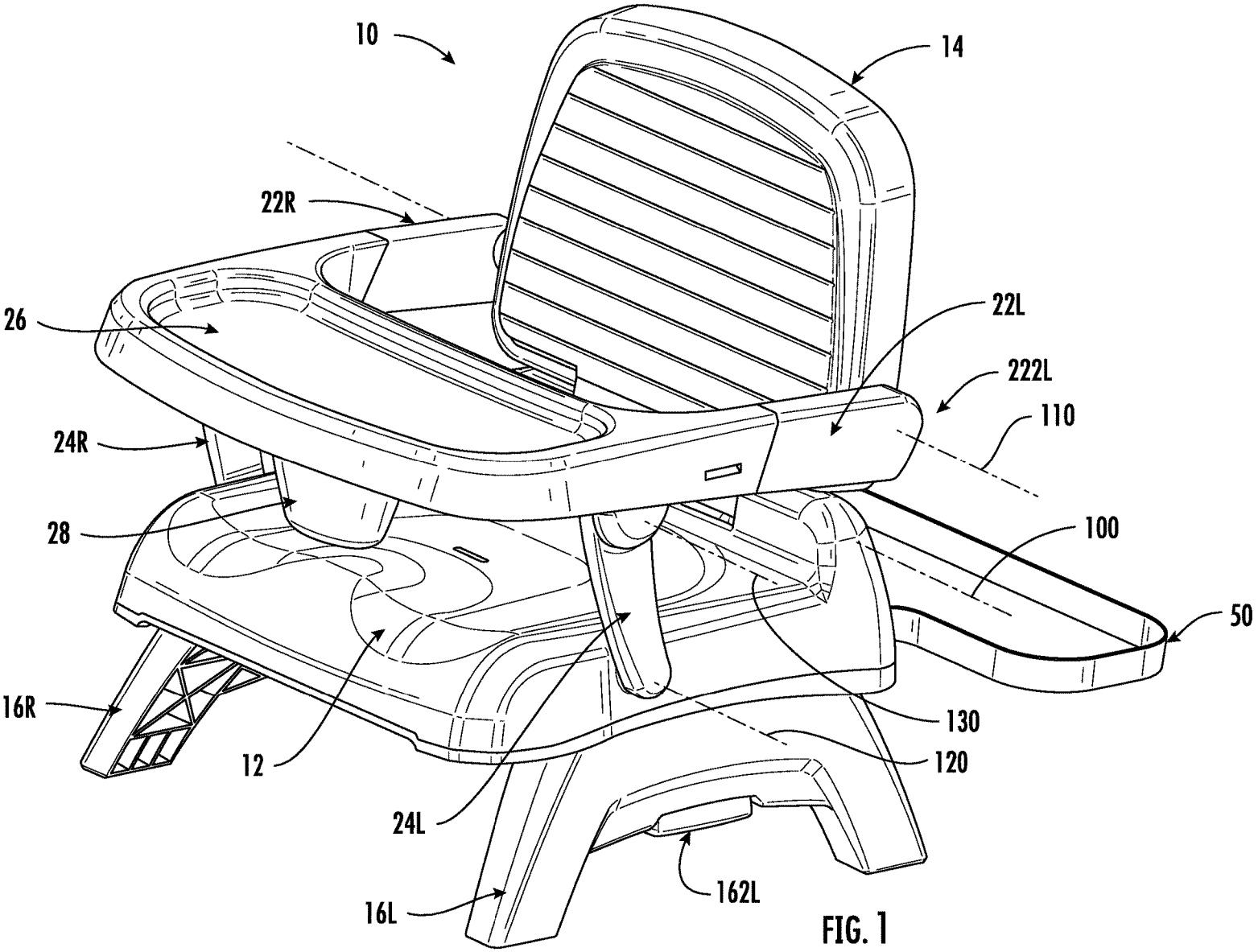
FIG. 1 is a perspective view of a convertible booster seat embodying aspects of the present invention shown with folding legs deployed for use as a free-standing chair.
Figure 2:
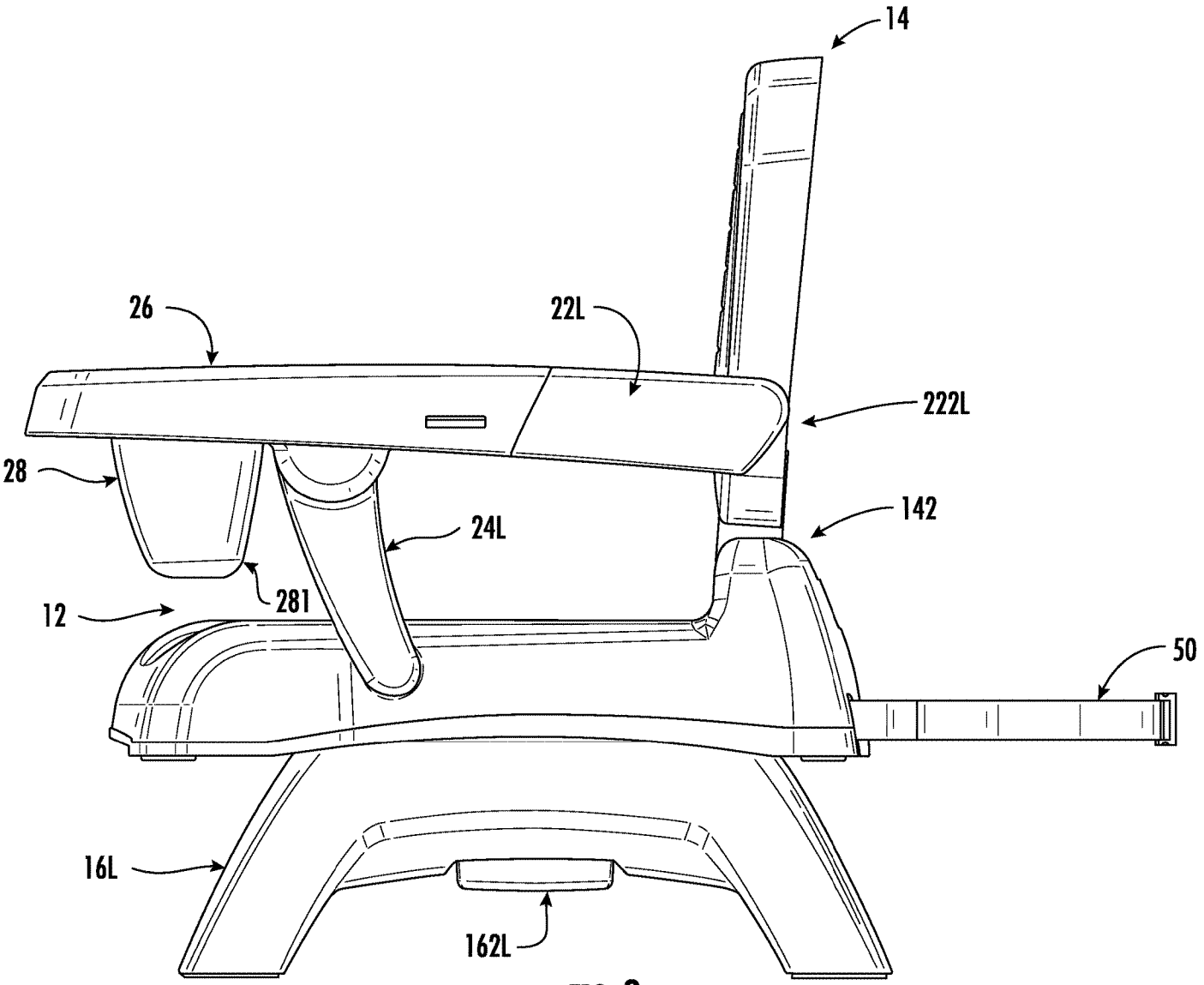
FIG. 2 is a side elevation view of the convertible booster seat of FIG. 1.
Figure 3:
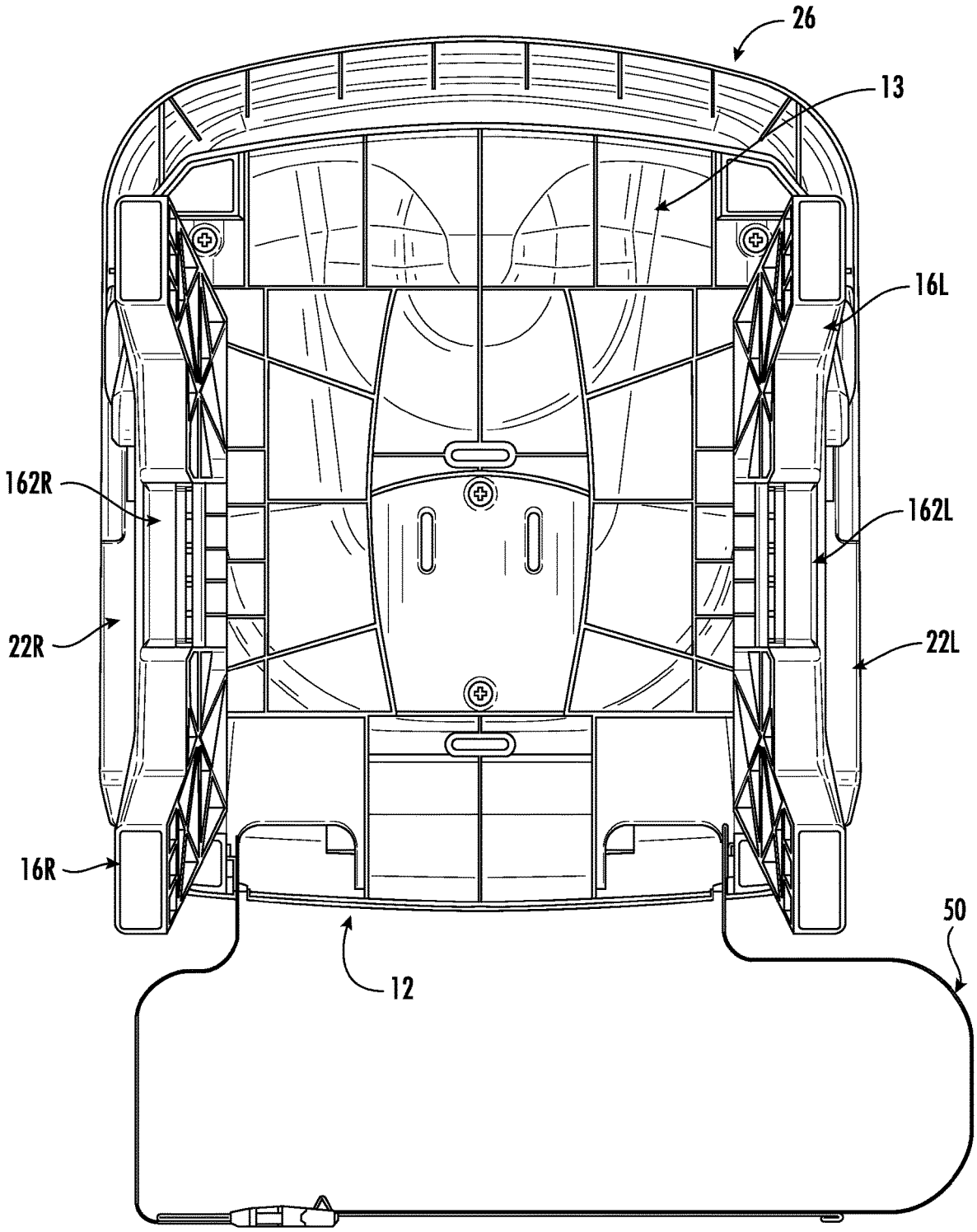
FIG. 3 is a view from underneath the convertible booster seat of FIG. 1.
Figure 4:
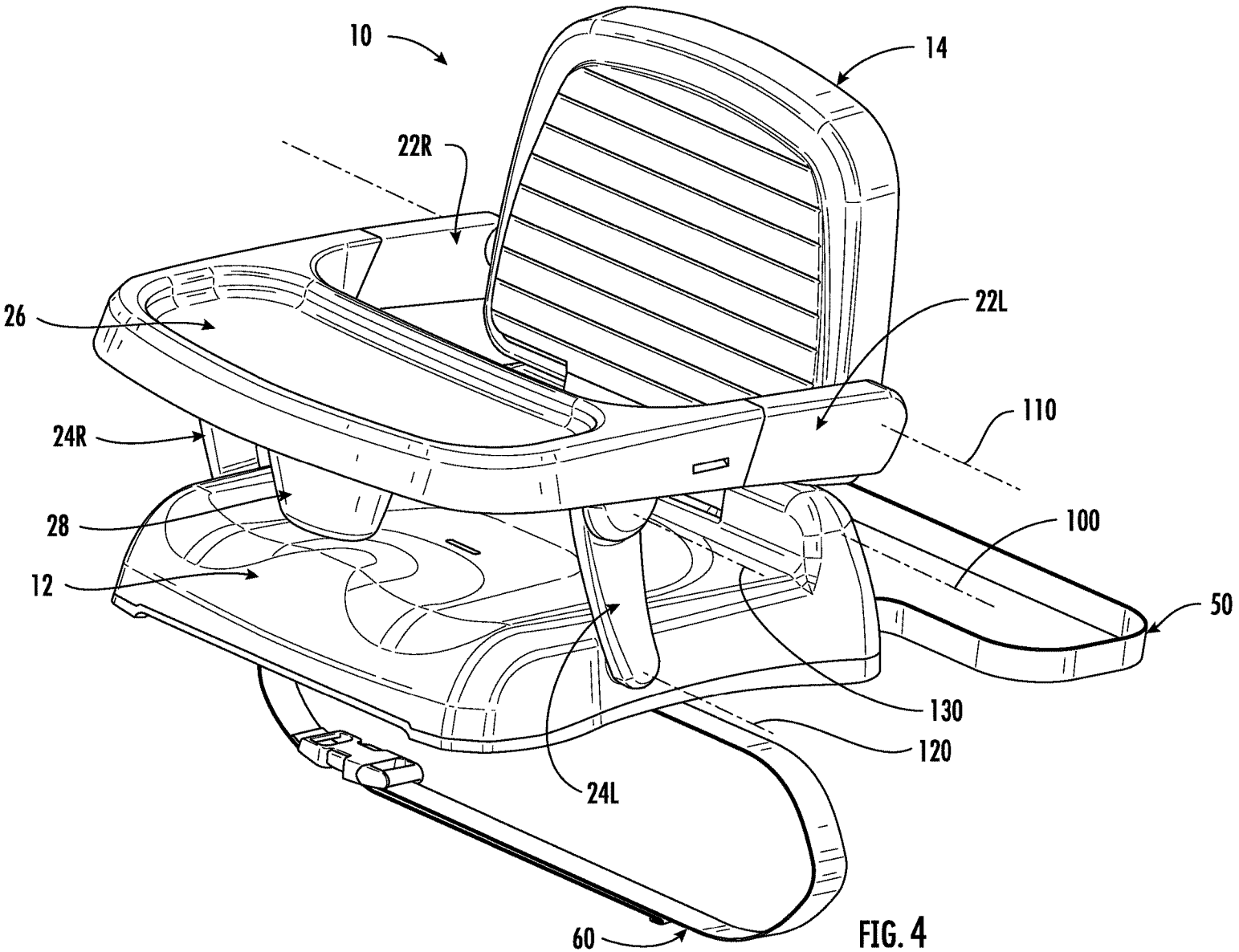
FIG. 4 is a perspective view of the convertible booster seat of FIG. 1 shown with folding legs stowed or folded for use as a booster seat.
Figure 5:
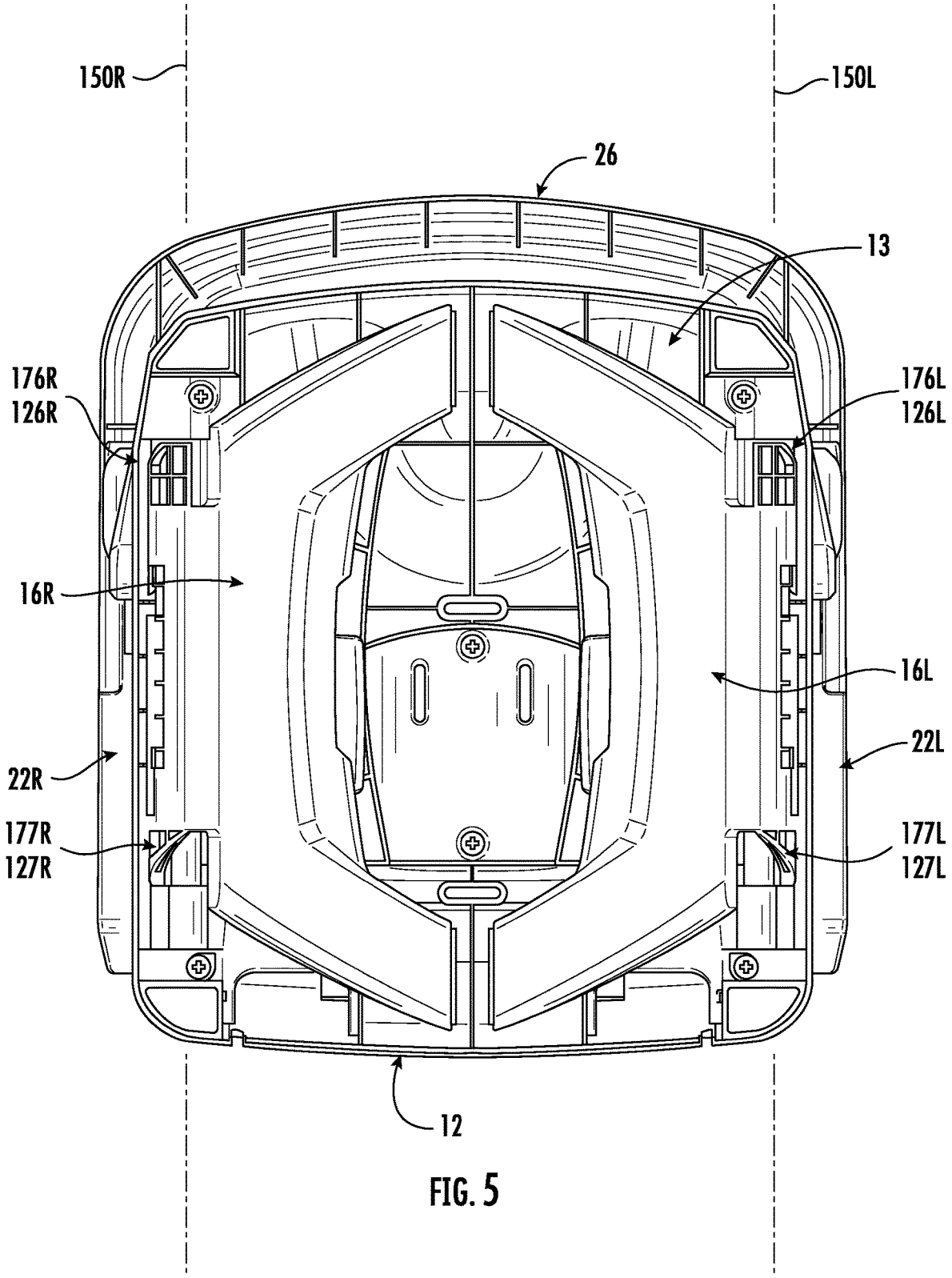
FIG. 5 is a view from underneath the convertible booster seat shown in FIG. 4.
Figure 6:
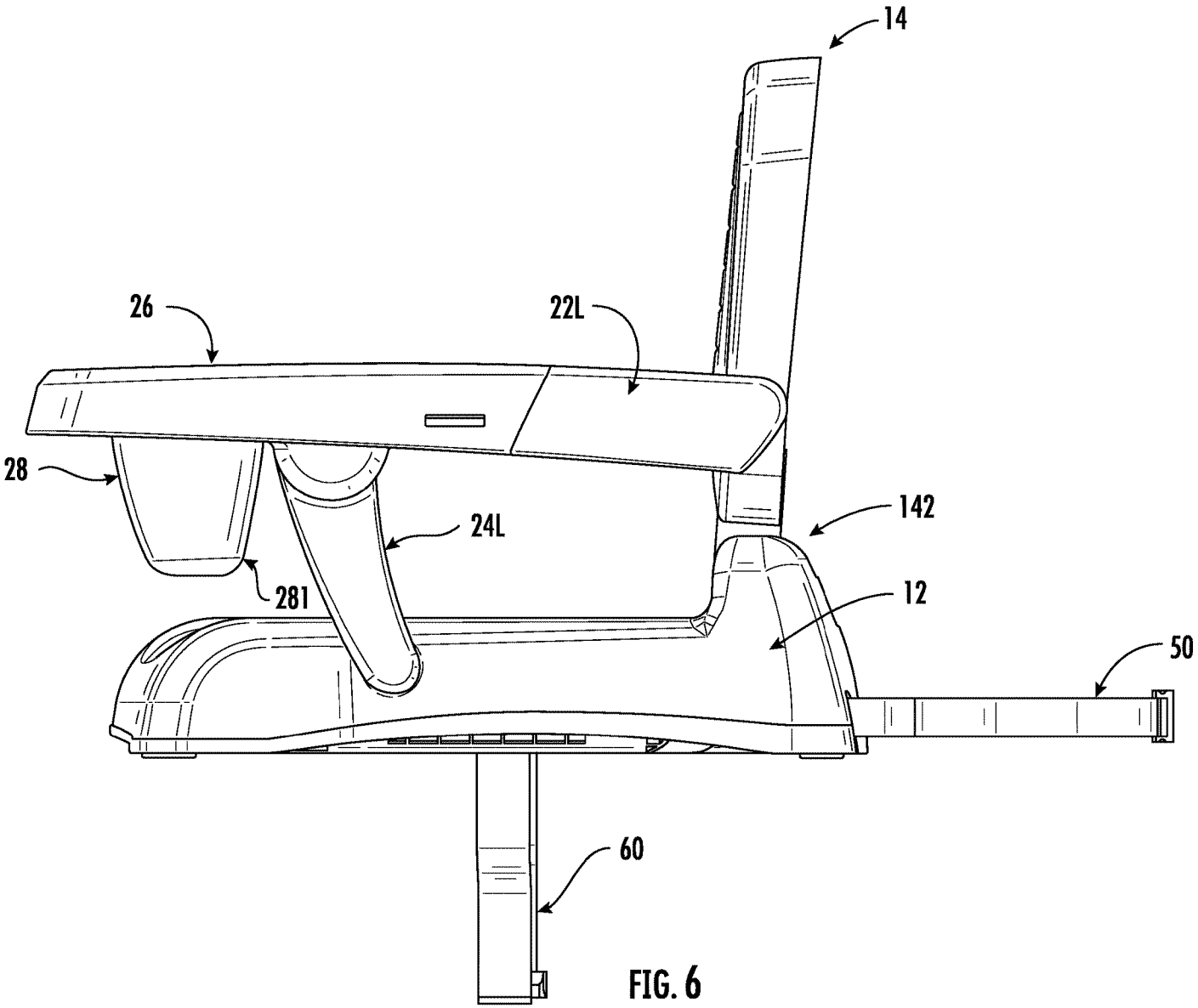
FIG. 6 is a side elevation view of the convertible booster seat of FIG. 4.

Referring to the FIGS., there is illustrated a child seat 10 convertible for use as a free-standing chair (FIG. 1) and a booster seat (FIG. 4). Child seat 10 includes a base 12 with a seating surface 11 upon which a child may sit, and a backrest 14. Child seat 10 is convertible between a free-standing chair and a booster seat through the repositioning of legs 16R, 16L which are moveably coupled to base 12 and configurable in an elevated configuration (FIGS. 1-3) or a non-elevated configuration (FIGS. 4-5). When in the elevated configuration, legs 16R, 16L increase the elevation of base 12 above a surface upon which the child seat rests compared to the elevation when the legs are in the non-elevated (folded) configuration.

Figure 7:
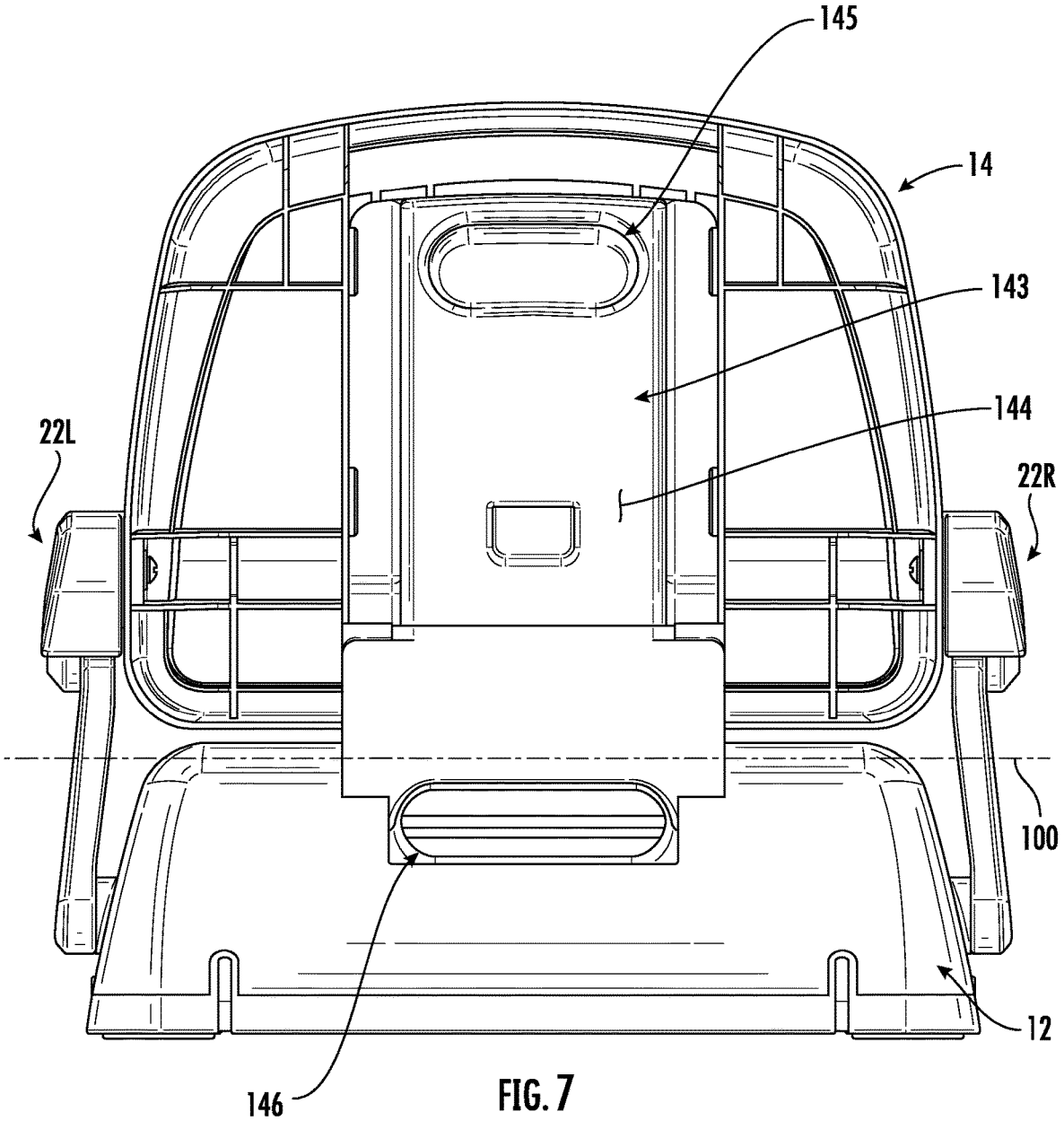
FIG. 7 is a rear elevation view of the convertible booster seat of FIG. 4.
Figure 8:
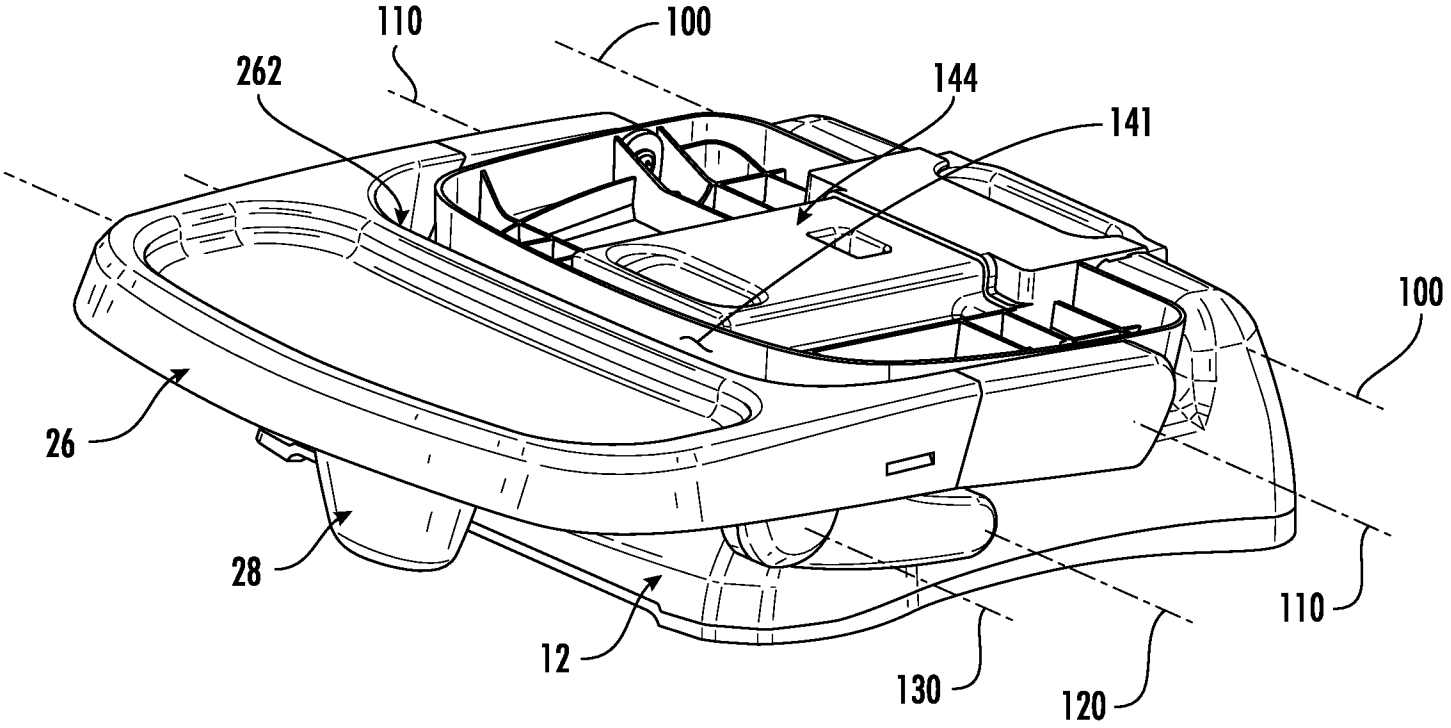
FIG. 8 is a perspective view of the convertible booster seat of FIG. 1 shown in the fully folded configuration.
Figure 9:
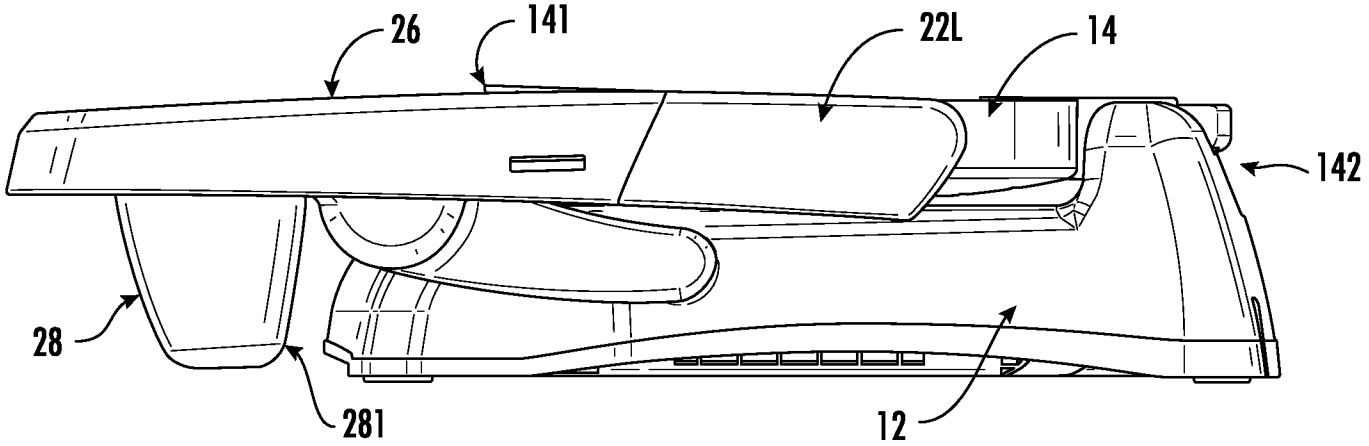
FIG. 9 is a side elevation view of the convertible booster seat as configured in FIG. 8.
Figure 10:
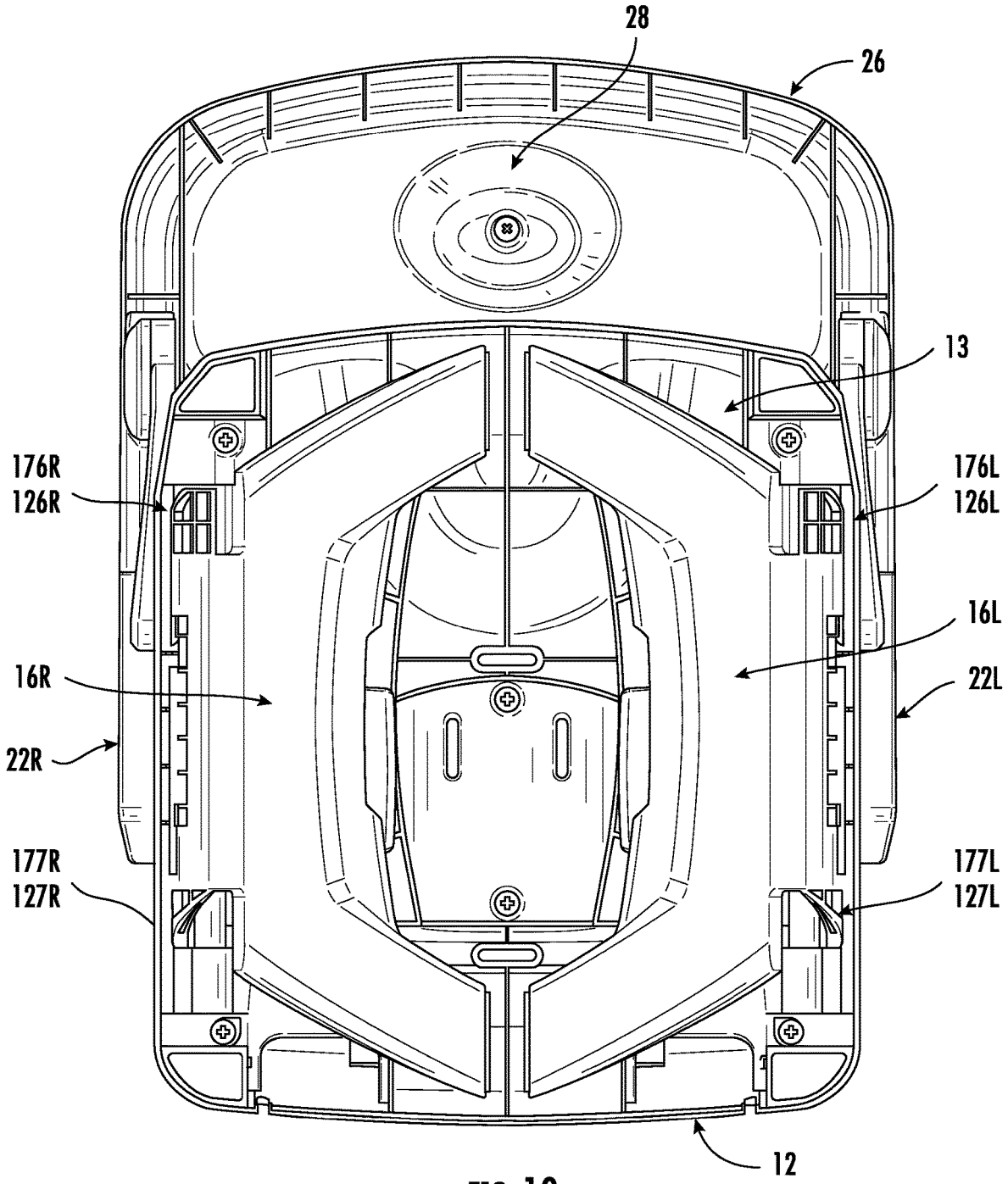
FIG. 10 is a bottom view of the convertible booster seat as configured in FIG. 8.
Figure 11:
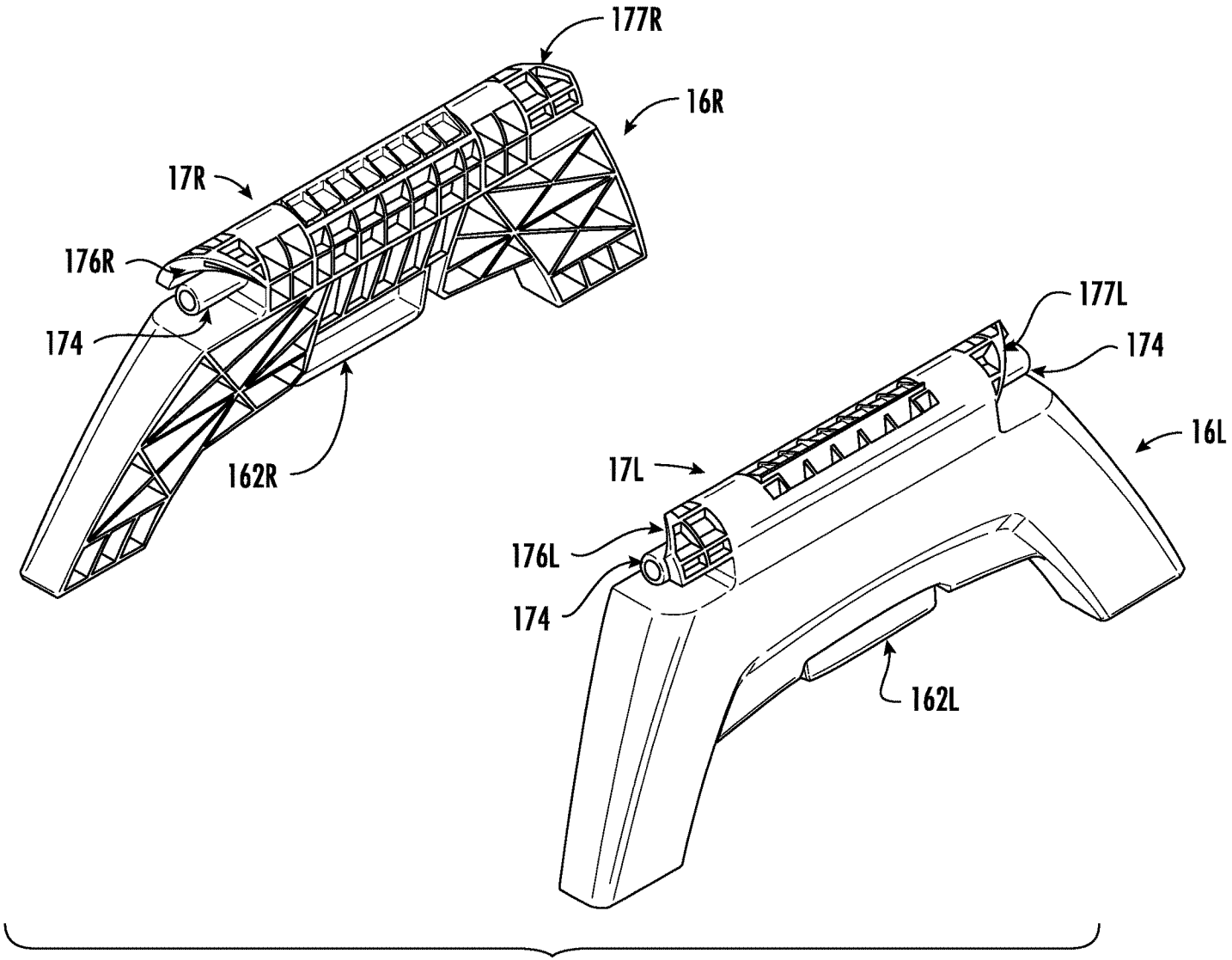
FIG. 11 is a partial view of the folding legs illustrating one embodiment of a longitudinal displacement cam.
Figure 12:
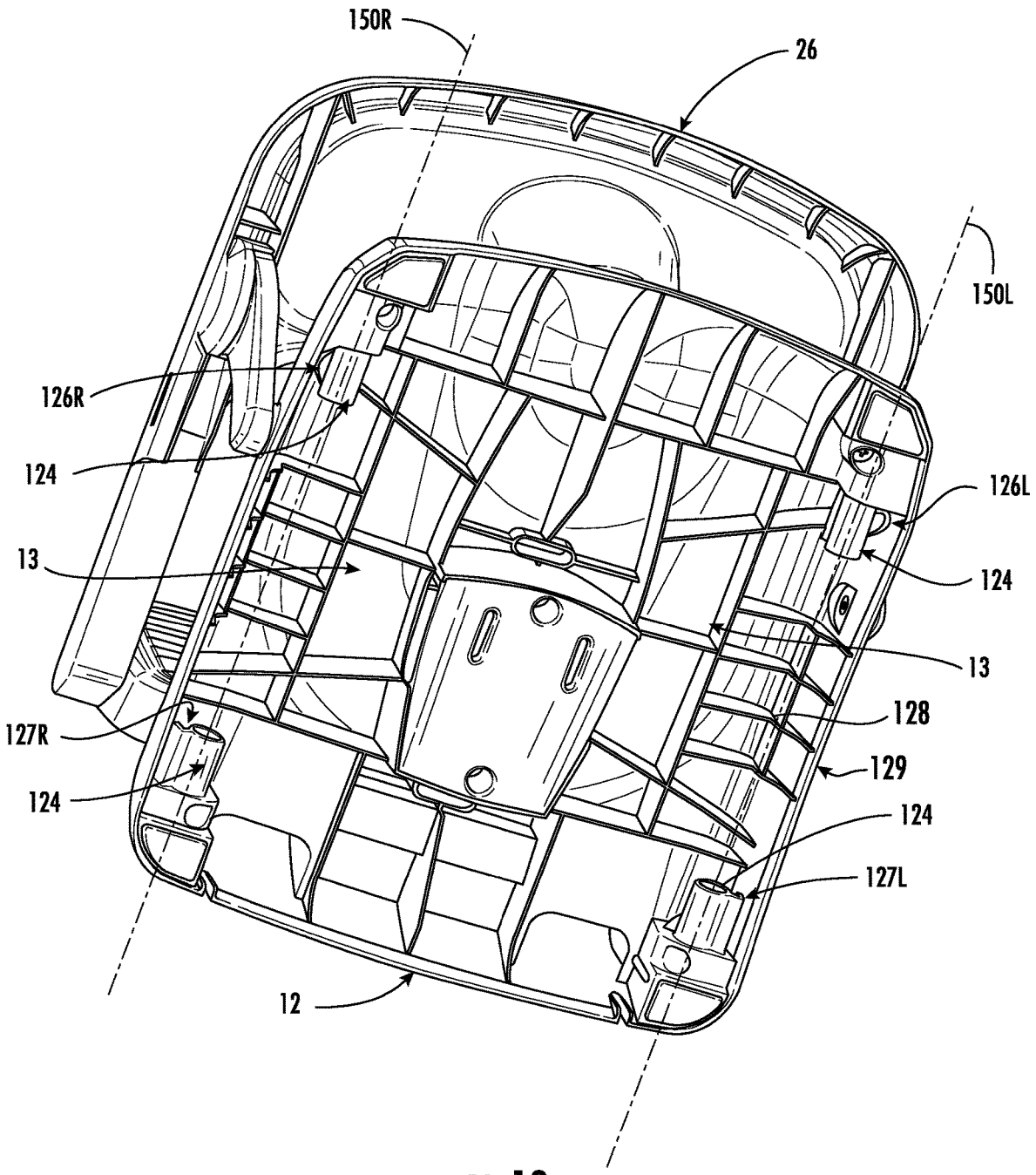
FIG. 12 is a partial view of the underside of the seat base showing the folding connection for the folding leg of FIG. 11 and the longitudinal cam guide.

As best illustrated in FIGS. 7 and 8, backrest 14 is pivotally coupled to base 12 at a pivot connection 142 enabling pivoting about backrest axis 100 between upright and folded positions. The upright position of backrest 14 illustrated in FIG. 1 allows a child to occupy the child seat 10. The folded position illustrated in FIG. 8 allows the child seat to be compactly configured for storage or transport.

The backrest 14 may include a backrest latching mechanism 143 configured to retain the backrest in the upright orientation. The latching mechanism is moveable to enable selective release of the backrest to permit folding of the backrest in relation to the seat base. The latching mechanism is preferably disposed on the backrest and may include a sliding member 144 bi-directionally moveable to engage a portion of the seat base to retain the backrest in an upright orientation and, when selectively moved in an opposite direction, to disengage from the seat base and allow movement of the backrest. Movement of sliding member 143 may be effected by an actuator 145 configured to enable a user to easily reposition the sliding member. The latching mechanism may further comprise a carry handle 146 configured to allow a user to easily carry the child seat when in the folded configuration. The carry handle may be positioned to allow the folded seat to hang beneath the carry handle when being carried by a user.

The backrest pivot connection 142 to the seat base may include a detent or similar bias mechanism to retain the backrest in a folded position. User movement of the backrest 14 from the folded position is possible by applying sufficient force to the backrest to overcome the bias force.

Armrests 22R, 22L may be provided and pivotally connected at proximal end 222R, 222L to backrest 14 for movement about armrest axis 110. Armrest supports 24R, 24L pivotally interconnect armrests 22R, 22L and base 12 at respective axes 120, 130 creating a linkage that coordinates folding movement of the armrest with folding movement of the backrest. The linkage is preferably configured to move the armrests forwardly and downwardly as the backrest is moved toward the folded position. When folded, the armrests are positioned laterally adjacent to the backrest to minimize the height dimension of the folded seat.

Tray 26 may be provided and connected to the armrest 22R, 22L for movement therewith. The tray improves utility of the child seat 10 by providing a bounded surface to contain food or other items that might interest a child occupant of the seat. Tray 26 also helps to restrain a child occupant within the seat, when attached, by its position above the legs and lap of the child occupant. Tray horn 28 may be provided on the tray to prevent child occupant from sliding out of the seat when tray is attached by limiting the open space beneath the tray and above the seating surface 11.

Articulated folding motion of the armrests and armrest supports as the seat is folded displaces tray 26 forwardly and downwardly. The articulated motion and location of the tray horn is configured to displace the position of the end 281 of the tray horn 28 ahead of the forward end of the seat base so that a portion of the horn may extend below the upward-facing surface of the seat base when fully folded for more compactness. The rear end 262 of the tray is contoured to allow the backrest 14 to fold adjacent to the seat base without the top end 141 of the backrest 14 impacting the tray which might otherwise limit the degree to which the backrest could be folded.

Moveable legs 16R, 16L are connected to base 12 by respective couplings 17R, 17L each of which may include an axle portion 174 engageble with one or more axle receptacles 124. In the illustrated embodiment, axle portion 174 is disposed on the moveable leg and axle receptacle 124 is disposed on base 12. Axle portions and receptacles may be configured without side-specific construction. Reversal of the relative locations of the axle portion and axle receptacle is contemplated.

Each coupling 17R, 17L further includes a cam and guide arrangement configured to displace the leg longitudinally in relation to the seat base as the leg is moved between elevated and non-elevated configurations. Leg couplings comprise one or more cams 176, 177 engageable with cam guides 126, 127 to cause longitudinal displacement as the legs are rotated. The cam-to-cam guide configuration is side-specific (cams 176R, 177R, 176L, 177L; cam guides 126R, 127R, 126L, 127L). The cam and cam guide profiles on respective legs are generally helical and mirror each other to cause longitudinal leg displacement in the same direction even though the legs are rotated in opposite directions as they are moved between elevated and non-elevated configurations. In the illustrated embodiment, a cam 176 and cam guide 126 are oppositely disposed at respective ends of the leg pivot axis 150R, 150L of the respective legs to control the fore-aft displacement of the legs as a function of rotation. The control prevents the legs from moving freely for or aft along the pivot axis.

Base 12 includes a cavity 13 on the underside opposite of the seating surface 11 into which legs 16R, 16L are received when configured in the non-elevated (folded) orientation. This arrangement and the configuration of the legs allows child seat 10 to reset stably on a surface when the legs are in the non-elevated (folded) orientation.

The fore-aft displacement of legs 16 along their respective pivot axes 150 moves the legs forwardly as they are pivoted toward the non-elevated (folded) positions so they may be received in cavity 13 on the underside of the seat base. Unfolding the legs to rotating them toward the elevated position causes rearward displacement of the legs along the pivot axes 150. This rearward displacement of the legs improves stability of the seat when it is used as a free-standing chair.

Figure 13:
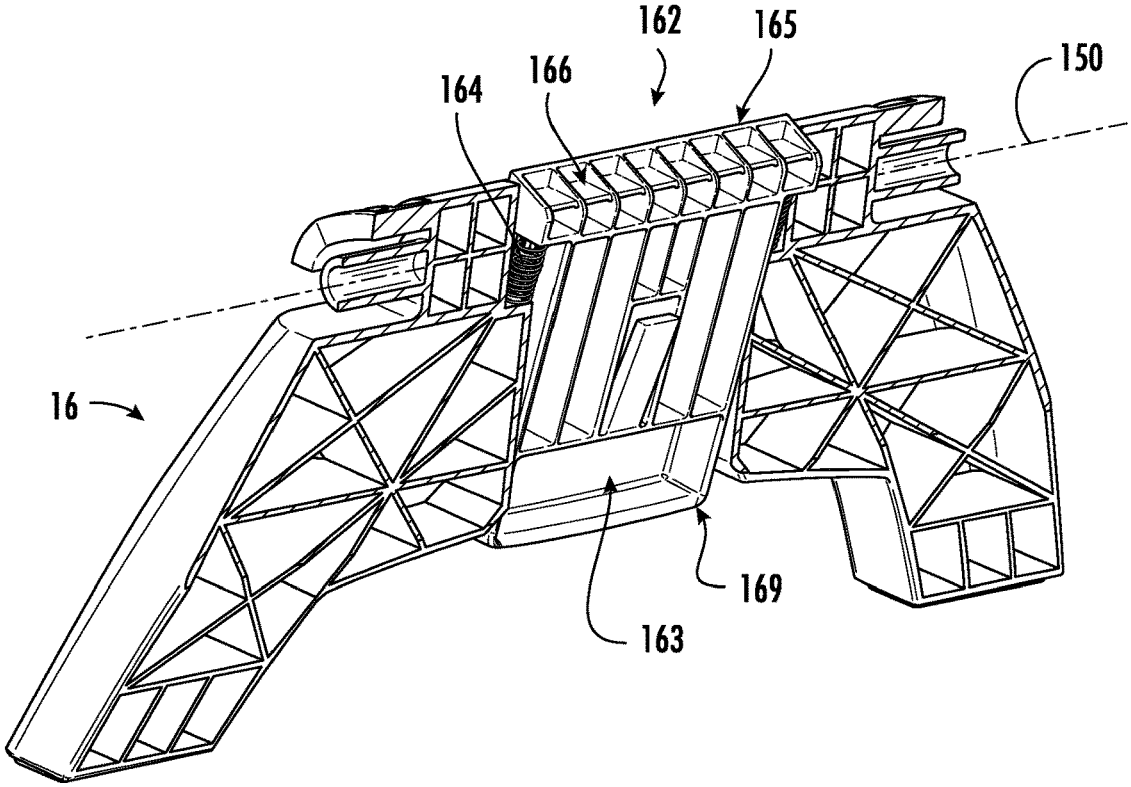
FIG. 13 is a partial cutaway view of a folding leg illustrating the leg latching mechanism in the latched configuration.
Figure 14:
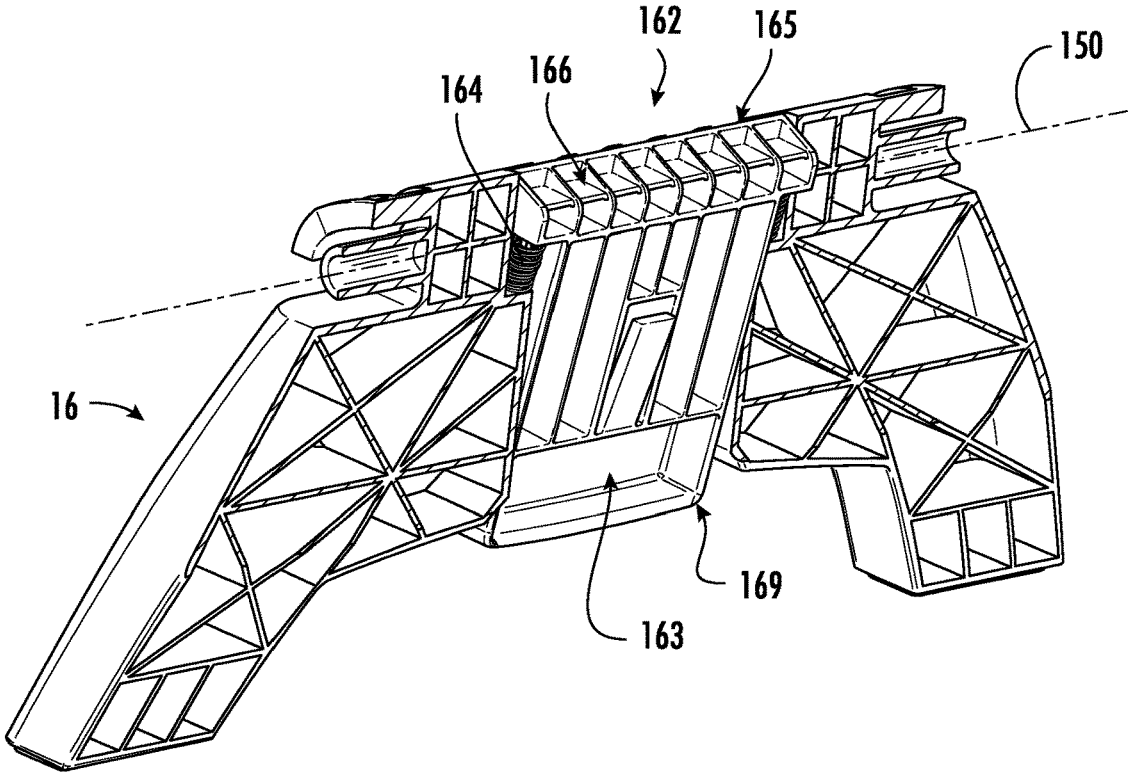
FIG. 14 is a partial cutaway view of a folding leg illustrating the leg latching mechanism positioned to release the latch.

Legs 16R, 16L each include a leg latching mechanism 162R, 162L configured to releasably lock the selective legs into the elevated configuration. Right and left side reference designations have been omitted from FIGS. 13 and 14 for clarity; the same features may be present in both latching mechanisms. Each leg latching mechanism 162 may comprise a bi-directionally moveable sliding member 163 which is slideable between latched (FIG. 13) and released (FIG. 14) positions. Sliding member 163 includes a latching end 165 engageable with a latching structure 128 formed in the seat base to hold the leg 16 in the elevated (unfolded) orientation. An actuator end 169 is disposed opposite to the latching end to provide an interface for a caregiver to selectively release the latching mechanism to move the legs. The leg latching mechanism 162 may include a resilient member 164 to bias the position of the sliding member 163 toward a latched position. In the illustrated embodiment, the sliding member 163 in the leg latching mechanism 162 is moved inwardly toward the leg pivot axis 150 to lock the leg into position and is moved in the opposite direction to disengage the latching end 165 from the latching structure 128 and allow the leg to pivot away from the elevated (unfolded) position. The latching mechanism may be released by pulling the actuator and sliding member outwardly away from the pivot axis 150. This movement retracts the latching end 165 and disengages it from the latching structure 128 allowing the leg to be rotated from the elevated (unfolded) position.

The leg latching mechanism 162 may also interact with the seat base to retain the legs in the non-elevated (folded) orientation. As the leg is moved to the non-elevated (folded) position, the sliding member is extended to the latched position by the biasing force where the latching end 165 engages a retaining edge 129 on the base 12. The sliding member also includes a ramp 166 which urges the sliding member away from the latched position against the biasing force as the leg 16 is rotated without any additional user action. User movement of the legs from the folded position is possible by applying sufficient force to each of the legs to overcome the resistance of the biasing force as the ramp urges the sliding member toward the released position. The interior surface of the seat base cavity 13 may further be configured with a guide to maintain contact with the latch end 165 as the leg rotates to urge the leg toward the unfolded position once the initial rotation begins.

While the exemplary embodiments illustrated in the figures and described herein are presently preferred, it should be understood that these embodiments are offered by way of example only. Accordingly, the present application is not limited to a particular embodiment but extends to various modifications that nevertheless fall within the scope of the appended claims. The order or sequence of any processes or method steps may be varied or re-sequenced according to alternative embodiments.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes, and omissions may be made in the design, operating conditions and arrangement of the exemplary embodiments without departing from the scope of the present application.

The invention claimed is:

1. A convertible chair for a child comprising:

a seat base;

an elevating leg; and a coupling mechanism connecting the elevating leg to the seat base and configured to simultaneously displace the elevating leg along an axis as the leg is rotated about the axis.

2. The convertible chair of claim 1, wherein the coupling mechanism comprises a cam.

3. The convertible chair of claim 1, wherein the coupling mechanism limits elevating leg rotation about the axis to between elevated and non-elevated configurations.

4. The convertible chair of claim 2, wherein the seat base further comprises an interior cavity configured to receive the elevating leg when in the non-elevated configuration.

5. The convertible chair of claim 3, wherein the coupling mechanism limits displacement of the elevating leg along the axis to between forward and rearward positions.

6. The convertible chair of claim 1, further comprising a backrest pivotally coupled to the seat base, an armrest pivotally coupled to the backrest, and a support link pivotally interconnecting the armrest and the seat base, the backrest being pivotable between opposing upright and folded configurations.

7. The convertible chair of claim 6, wherein the backrest further comprises a latching mechanism configured to selective secure the backrest in the upright configuration.

8. The convertible chair of claim 7, wherein the latching mechanism includes a handle.

9. The convertible chair of claim 6, further comprising a tray selectively attachable to the armrest for movement therewith, the tray having a downward projecting horn with an end that is disposed above an upfacing seating surface of the seat base when the backrest is in the upright position, and is disposed below the upfacing seating surface and forward of a forward end of the seat base when the backrest is in the folded position.

10. The convertible chair of claim of claim 1, further comprising a locking mechanism configured to releasably lock the elevating leg in a first predetermined orientation.

11. The convertible chair of claim 10, wherein the locking mechanism is further configured to resiliently retain the elevating leg in a second predetermined orientation.

12. A convertible booster seat for a child comprising:

a seat base having seating surface, a cavity oppositely disposed from the seating surface, and a fore-aft axis; and first and second elevating legs moveably connected to the seat base and positionable in generally opposing non-elevating and elevating positions;

wherein moving the elevating legs between the non-elevating and elevating positions rotates the legs about respective folding axes generally parallel to the fore-aft axis and simultaneously longitudinally displaces the elevating legs along the respective folding axes.

13. The convertible booster seat of claim 12, wherein the connection of the first and second legs to the seat base each pivot about respective first and second pivot axes.

14. The convertible booster seat of claim 13, wherein the respective connections of the first and second elevating legs each include a cam structure acting upon a guide structure disposed on the seat base, the cam and guide structures configured to cause fore-aft displacement of the first and second elevating legs, respectively, as each elevating leg is rotated about its pivot axis between the elevating and non-elevating positions, rotation of each leg toward the non-elevating position causing forward displacement of the leg enabling the leg to be received in the cavity.

15. The convertible booster seat of claim of claim 14, wherein each elevating leg further comprises a locking mechanism configured to releasably lock each respective elevating leg in the elevating position, the locking mechanism being further configured to resiliently retain each respective elevating leg in the non-elevating position.

16. The convertible booster seat of claim 12, further comprising a backrest rotatably connected to the seat base, and a pair of spaced-apart armrests pivotally coupled to the backrest and disposed adjacent to opposing lateral sides seat base, each armrest having a support link pivotally interconnecting the armrest and the seat base, the backrest being pivotable between opposing upright and folded configurations, the backrest movement moving the armrests in unison therewith.

17. The convertible booster seat of claim 16, further comprising a tray selectively attachable to the armrests to span the space between, the tray having a downward projecting horn with an end that is disposed above an upfacing seating surface of the seat base when the backrest is in the upright position, and is disposed below the upfacing seating surface and forward of a forward end of the seat base when the backrest is in the folded position.

18. The convertible booster seat of claim 16, wherein the backrest further comprises a latching mechanism configured to selective secure the backrest in the upright configuration.

19. The convertible booster seat of claim 18, wherein the latching mechanism include a handle.

* * * * *